United States Patent [19]

Bearden, Jr. et al.

[11] 4,051,015

[45] Sept. 27, 1977

[54] HYDROCONVERSION OF HEAVY HYDROCARBONS USING COPPER CHLORIDE CATALYST

[75] Inventors: Roby Bearden, Jr.; William C. Baird, Jr., both of Baton Rouge, La.

[73] Assignee: Exxon Research & Engineering Co., Linden, N.J.

[21] Appl. No.: 695,072

[22] Filed: June 11, 1976

[51] Int. Cl.[2] ..... C10G 23/02

[52] U.S. Cl. ..... 208/108; 208/191; 208/213; 208/251 H

[58] Field of Search ..... 208/108, 134, 143, 146, 208/191, 213, 219

[56] References Cited

U.S. PATENT DOCUMENTS

| | | | |
|---|---|---|---|
| 2,098,400 | 11/1937 | Pier et al. | 208/108 |
| 2,865,841 | 12/1958 | Hoekstra | 208/108 |
| 3,668,109 | 6/1972 | Kiovsky et al. | 208/108 X |
| 3,679,577 | 7/1972 | Wantland et al. | 208/108 |

FOREIGN PATENT DOCUMENTS

| | | | |
|---|---|---|---|
| 438,084 | 11/1935 | United Kingdom | 208/108 |

*Primary Examiner*—Delbert E. Gantz
*Assistant Examiner*—G. E. Schmitkons
*Attorney, Agent, or Firm*—Marthe L. Gibbons

[57] ABSTRACT

A heavy hydrocarbonaceous oil is converted to lower boiling products by treatment with hydrogen in the presence of a particulate acidic copper chloride catalyst.

9 Claims, 1 Drawing Figure

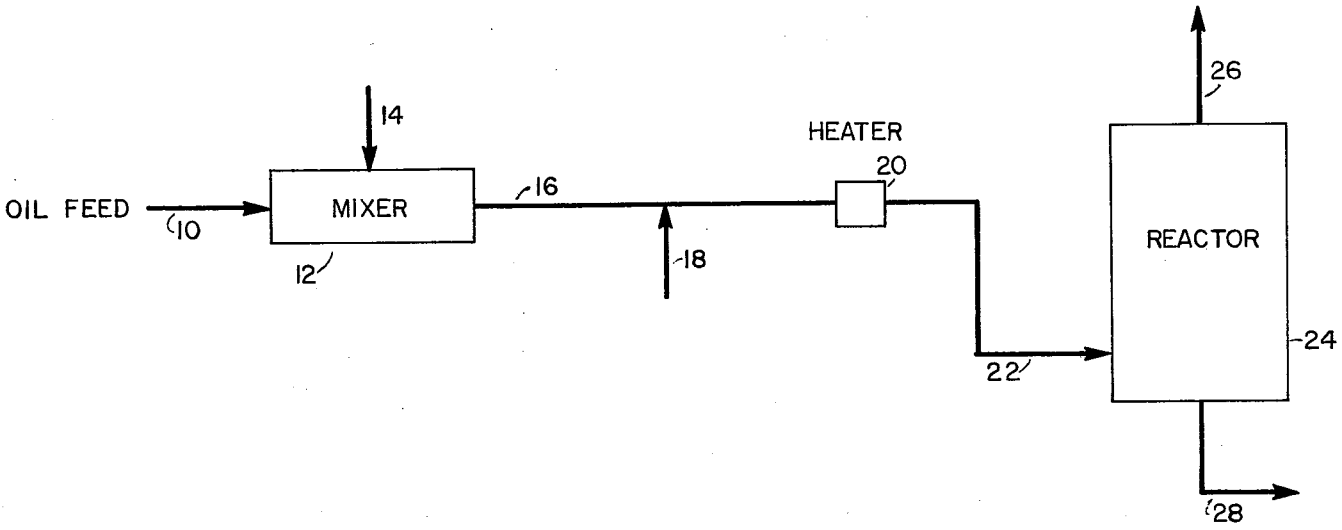
OIL FEED
10
MIXER
12
14
16
18
HEATER
20
22
REACTOR
24
26
28

HYDROCONVERSION OF HEAVY HYDROCARBONS USING COPPER CHLORIDE CATALYST

BACKGROUND OF THE INVENTION

1. Field of the Invention

The present invention relates to a process for the conversion of hydrocarbons to lower boiler products. More particularly, it relates to a hydroconversion process in which a continuous liquid phase hydrocarbon oil having dispersed therein a particulate acidic copper chloride catalyst is reacted with hydrogen.

2. Description of the Prior Art

Hydroconversion processes utilizing metal halide catalysts are known. The term "hydroconversion" is used herein to designate a catalytic process conducted in the presence of hydrogen in which at least a portion of the heavy constituents and coke precursors (as measured by Conradson carbon residue) of the hydrocarbonaceous oil is converted to lower boiling hydrocarbon products while simultaneously reducing the concentration of nitrogenous compounds, sulfur compounds and metallic contaminants.

U.S. Pat. No. 3,668,109 discloses a hydroconversion process in which the hydrocarbonaceous feed is contacted with a continuous liquid-phase metal halide catalyst.

U.S. Pat. No. 2,098,400 discloses a hydroprocessing of distillable carbonaceous material with a metal iodide-containing catalyst.

It has now been found that a hydroconversion process utilizing a particulate chloride of copper offers advantages which will become apparent in the following description.

SUMMARY OF THE INVENTION

In accordance with the invention, there is provided a process for the hydroconversion of a heavy hydrocarbonaceous oil to lower boiling materials which comprises: contacting, in a conversion zone, said oil with hydrogen and a particulate catalyst comprising an acidic metal chloride selected from the group consisting of cupric chloride, cuprous chloride and mixtures thereof, at a temperature of at least 750° F. and under a hydrogen partial pressure of at least about 500 psig.

BRIEF DESCRIPTION OF THE DRAWING

The FIGURE is a schematic flow plan of one embodiment of the invention.

DESCRIPTION OF THE PREFERRED EMBODIMENT

Referring to the FIGURE, a heavy hydrocarbonaceous oil feed is introduced by line 10 into mixer 12. Suitable heavy hydrocarbonaceous oil feeds include heavy mineral oils; petroleum crude oils, including heavy crude oils; polynuclear aromatics such as asphaltenes; residual oils such as petroleum atmospheric distillation tower residuum and petroleum vaccum distillation tower residuum (vacuum residuum); tars; bitumen; tar sand oils; shale oils, heavy liquids derived from coal liquefaction processes. The process is particularly well suited to convert non-distillable oils such as vacuum residuum.

The hydrocarbonaceous oil utilized in the process of the present invention may contain up to 10 weight precent sulfur contaminants and up to 10,000 weight ppm metallic contaminants (nickel, iron, vanadium, etc.). A catalyst is introduced into mixer 12 via line 14 to disperse the finely divided catalyst particules in the oil feed.

The catalyst comprises an acidic chloride of copper selected from the group consisting of cuprous chloride, copric chloride and mixtures thereof. The preferred chloride of copper is cuprous chloride.

Suitable concentration of the catalyst in the oil ranges from about 1 to about 50 weight percent based on the oil feed, preferably from about 1 to about 20 weight percent. The oil-catalyst mixture, in which the oil is the liquid continuous phase having dispersed therein finely divided catalyst particules, is removed from mixer 12 via line 16. Hydrogen via line 18 is injected into the oil-catalyst mixture. The oil-catalyst-hydrogen mixture is then passed through a heater 20 where the mixture is preheated to below reaction temperature. The preheated mixture is removed via line 22 and passed to a hydroconversion reactor 24. Alternatively, the catalyst may be introduced directly into hydroconversion zone 24. The hydroconversion reaction zone is maintained at an average temperature of at least about 750° F., preferably in the range of about 750° to about 1500° F., more preferably in the range of about 800° F to about 900° F. and under a hydrogen partial pressure of at least about 500 pounds per square inch gauge (psig), preferably under a hydrogen partial pressure ranging from about 500 psig to about 5,000 psig, more preferably from about 1,000 to about 3,000 psig. Suitable total pressures in the hydroconversion zone include from about 500 to about 5,000 psig. Suitable hydrogen supply rates include from about 1,000 to about 5,000 standard cubic feet of hydrogen per barrel of oil feed. Contact times in the hydroconversion zone range from about 5 minutes to about 4 hours, preferably from about 15 minutes to about 2 hours. The hydroconversion reaction products are removed from reactor 24 via line 26 for separation by conventional means (not shown) into gaseous and liquid products. A stream of oil having dispersed therein catalyst particles is removed from reactor 24 via line 28. The catalyst may be separated from the oil by conventional means such as by settling or by use of liquid-solid cyclones. The separated catalyst may be recycled to the reaction zone. If desired, the catalyst may be cleaned or regenerated prior to recycling it to the reaction zone. The separated hydrogen may also be recycled to the reaction zone.

The following examples are presented to illustrate the invention:

Several sets of comparative hydroconversion experiments were made. Detailed inspections on various feeds used in these experiments are listed in Table I. The experimental procedure used in these experiments was as follows:

An Autoclave Engineers 300cc Hastelloy C stirred autoclave was charged with 90–100g. of feed and the desired quantity of copper halide. The autoclave was purged with hydrogen and pressurized to 1700–1800 psig. The reaction was heated and stirred at 820° ± 10° F for 1 hour. The reactor was cooled to room temperature, and the gas was vented through a cadmium acetate scrubber to remove hydrogen sulfide. The gas volume was measured with a wet test meter, and the gas was collected for analysis. The liquid product was recovered by decantation, and the yield and API gravity were obtained. The inorganic residue was collected and washed with toluene to remove residual oil. The liquid product was analyzed for sulfur, nitrogen, nickel, vanadium, iron, Conradson carbon, and asphaltenes. the boiling point curve was determined by gas chromatographic distillation. The iorganic residue was vacuum dried at 110° C overnight and analyzed for coke.

EXAMPLES 1 TO 7

A series of hydroconversion experiments was made at 820° F, 1800 psig hydrogen pressure for 1 hour utilizing Safaniya atmospheric residuum over copper halides. The results of this series of experiments are summarized in Table II.

Comparison of examples 1 and 2 shows the superior performance of cuprous chloride over cuprous iodide at equivalent loadings. Cuprous chloride affords greater nitrogen removal and Conradson carbon conversion to liquid product than does the cuprous iodide. The product contains no 1050° F+ residue.

Examples 3 and 4 show that cuprous chloride at 5 weight percent on oil provides better overall results than does cuprous iodide at the 22 weight percent level. Only at this level does cuprous iodide surpass the chloride in nitrogen removal; however, the liquid yield remains lower and the product distribution tends to be heavier as shown by the greater 650/1000 ° F content.

Examples 5 to 7 show the advantages of cupric chloride-treating over cuprous iodide over the concentration range of 2 to 5 weight percent. Nitrogen removal capacity is retained by the chloride at these loadings, although the yield advantage is not apparent. Product quality overall still favors the chloride.

TABLE I

| Feedstock Designation | Safaniya Atmospheric Residuum | Safaniya Vacuum Residuum | Jobo Crude |
|---|---|---|---|
| API Gravity | 14.4 | 4.6 | 8.5 |
| Sulfur, Wt. % | 3.91 | 5.20 | 3.8 |
| Nitrogen, Wt. % | 0.26 | 0.41 | 0.7 |
| Carbon, Wt. % | 84.42 | — | 83.92 |
| Hydrogen, Wt. % | 11.14 | - | 10.49 |
| Oxygen, Wt. % | 0.27 | — | 0.57 |
| Conradson Carbon, Wt. % | 11.8 | 23.7 | 13.8 |
| Ash, Wt. % | — | — | |
| Water, Karl Fisher, Wt. % | — | — | |
| Metals, ppm | | | |
| Ni | 20 | 53 | 85 |
| V | 77 | 171 | 465 |
| Fe | 4 | 28 | 20 |
| Viscosity | | | |
| VSF at 122° F. | 235 | — | |
| 140° F. | 131 | — | |
| 210° F. | — | — | |
| Pour Point, ° F | 33 | 120 | |
| Naphtha Insolubles, Wt. % | 7 | 17.4 | |
| Distillation | | | |
| IBP, ° F. | 464 | 1049 | 518 |
| 5% | 569 | | 629 |
| 10% | 632 | | 682 |
| 20% | 724 | | 798 |
| 30% | 806 | 895 | |
| 40% | 883 | 978 | |
| 50% | 962 | 1037 | |
| 60% | 1037 | | |
| 70% | | | |
| 80% | | | |
| 90% | | | |
| 95% | | | |
| FBP | 1035 | | |
| % Rec. | 59.2 | 58.0 | 51.8 |
| % Res. | 40.8 | 42.0 | 48.2 |

TABLE II

HYDROCONVERSION OF SAFANIYA ATMOSPHERIC RESIDUUM OVER COPPER HALIDES

| Example No. | 1 | 2 | 3 | 4 | 5 | 6 | 7 |
|---|---|---|---|---|---|---|---|
| Copper halide | CuI | CuCl | CuCl | CuI | $CuCl_2$ | $CuCl_2$ | CuI |
| Wt. % on oil | 10 | 11 | 5 | 22 | 5 | 3 | 2 |
| Desulfurization, % | 67 | 62 | 62 | 67 | 46 | 49 | 34 |
| Demetallization, % | 97 | 95 | 97 | 91 | 96 | 95 | 88 |
| Denitrogenation, % | 54 | 73 | 73 | 77 | 62 | 65 | 38 |
| Conradson Carbon loss, % | 76 | 79 | 72 | 75 | 72 | 60 | 52 |
| API gravity | 28.6 | 32.3 | 29.2 | 32.2 | 31.1 | 29.7 | 28.8 |
| Coke, Wt. % | 4.0 | 1.7 | 2.0 | 2.7 | 1.9 | 4.0 | 2.8 |
| $C_5$ gas, Wt. % | 6.2 | 4.3 | 2.7 | 6.1 | 4.7 | 3.9 | 4.2 |
| $C_5$+ liquid, Wt. % | 89.8 | 94.0 | 95.3 | 91.2 | 93.4 | 92.1 | 93.0 |
| $C_5$/430, Wt. % | | 40 | | 40 | | | |
| 430/650, Wt. % | | 30 | | 25 | | | |
| 650/1000, Wt. % | | 30 | | 35 | | | |

EXAMPLES 8 TO 13

A series of hydroconversion experiments was made at 820° F, 1800 psig hydrogen pressure for 1 hours, to compare the performance of various copper salts with two highly refractory feeds, namely, Safaniya vacuum residuum and Jobo crude. The results of these experiments are summarized in Table III. As can be seen from Table III, the product improvement is greater with the chlorides at equivalent liquid yields. Coke yields for these feeds tend to be higher due to the extremely heavy nature of these feeds.

The data of Tables II and III show the superior performance of cupric and cuprous chloride over cuprous iodide as a hydroconversion reagent. In general, the copper chlorides provide higher liquid yields, lower coke yields and better product quality at lower reagent loadings than does cuprous iodide.

TABLE III

HYDROCONVERSION OF HEAVY FEEDS OVER COPPER HALIDES

| Example No. | 8 | 9 | 10 | 11 | 12 | 13 |
|---|---|---|---|---|---|---|
| | Safaniya Vacuum Residuum | | | Jobo Crude | | |
| Copper Halide | CuI | CuCl | $CuCl_2$ | $CuCl_2$ | CuCl | CuI |
| Wt. % on feed | 5 | 6 | 5 | 2 | 2 | 2 |
| Desulfurization, % | 42 | 54 | 43 | 36 | 38 | 48 |
| Demetallization, % | 92 | 98 | 98 | 97 | 94 | 93 |
| Denitrogenation, % | 49 | 78 | 76 | 66 | 50 | 39 |
| Conradson Carbon, % loss | 70 | 79 | 73 | 62 | 54 | 51 |
| Coke, Wt. % | 4.9 | 8.0 | 7.3 | 3.0 | 3.7 | 1.8 |
| $C_5$, gas, Wt. % | 5.5 | 5.5 | 4.9 | 4.7 | 5.0 | 4.8 |
| $C_5$+ liquid, Wt. % | 89.6 | 86.5 | 87.2 | 92.3 | 91.3 | 93.4 |
| API gravity | 28.5 | 29.6 | 27.9 | 28.4 | 26.9 | 25.8 |

What is claimed is:

1. A process for the hydroconversion of a heavy hydrocarbonaceous oil, which comprises contacting said oil in liquid continuous phase with hydrogen and a particulate catalyst consisting essentially of a chloride of copper selected from the group consisting of cuprous chloride, cupric chloride an mixtures thereof, said catalyst being present in said oil in an amount ranging from about 1 to about 50 weight precent, at a temperature ranging from about 800° to about 900° F. under a hydrogen partial pressure ranging from about 500 to about 5,000 psig.

2. A process for the hydroconversion of a heavy hydrocarbonaceous oil, which comprises contacting said oil in liquid continuous phase with hydrogen and a particulate catalyst consisting essentially of a chloride of copper selected from the group consisting of cuprous chloride, cupric chloride and mixtures thereof, said catalyst being present in said oil in an amount ranging from about 1 to about 50 weight percent, at a temperature of at least 750° F. and under hydrogen partial pressure of at least about 500 psig.

3. The process of claim 2, wherein said chloride of copper is cuprous chloride.

4. The process of claim 2, wherein said chloride of copper is cupric chloride.

5. The process of claim 2, wherein said heavy hydrocarbonanceous feed is selected from the group consisting of heavy crude oils, hydrocarbon distillable fractions, and residual oils.

6. The process of claim 2, wherein said heavy hydrocarbon oil is a vacuum residuum.

7. The process of claim 2, wherein said temperature ranges from about 750° to about 1500° F.

8. The process of claim 2, wherein said temperature ranges from about 800° to about 900° F.

9. The process of claim 2, wherein said particulate catalyst is dispersed in said hydrocarbon oil, said catalyst being present in said oil in an amount ranging from about 1 to about 20 weight percent.

* * * * *